US005667013A

United States Patent [19]

Bain

[11] Patent Number: 5,667,013

[45] Date of Patent: Sep. 16, 1997

[54] METHOD AND APPARATUS FOR SUPPORTING CASING STRING FROM MOBILE OFFSHORE PLATFORM

[76] Inventor: Billy Ray Bain, 12131 Broken Bough, Houston, Tex. 77024

[21] Appl. No.: 571,553

[22] Filed: Dec. 13, 1995

[51] Int. Cl.[6] ..... E02B 17/00

[52] U.S. Cl. ..... 166/348; 405/195.1; 405/224.4

[58] Field of Search ..... 166/335, 341, 166/348, 360, 75.14; 405/195.1, 224.4

[56] References Cited

U.S. PATENT DOCUMENTS

| | | | |
|---|---|---|---|
| 2,995,900 | 10/1961 | Hunsucker . | |
| 3,528,497 | 9/1970 | Lehman | 166/360 |
| 3,653,635 | 4/1972 | Bates, Jr. et al. | 166/352 X |
| 4,003,428 | 1/1977 | Zehren | 166/348 X |
| 4,090,367 | 5/1978 | Verschure . | |
| 4,109,478 | 8/1978 | Garcia . | |
| 4,154,298 | 5/1979 | Gano | 166/348 X |
| 4,191,256 | 3/1980 | Croy et al. | 166/343 |
| 4,389,140 | 6/1983 | Borde | 405/195 |
| 4,456,072 | 6/1984 | Bishop | 166/335 |
| 4,484,839 | 11/1984 | Nandial et al. | 405/211 |
| 4,662,784 | 5/1987 | Hipp | 405/169 |
| 4,842,446 | 6/1989 | Carruba | 405/227 |
| 4,907,657 | 3/1990 | Cox | 175/9 |
| 4,932,811 | 6/1990 | Folding | 405/227 |
| 4,958,960 | 9/1990 | Turner | 405/195 |
| 5,012,875 | 5/1991 | Casbarian | 175/9 |

*Primary Examiner*—William P. Neuder
*Attorney, Agent, or Firm*—Pravel, Hewitt, Kimball & Krieger

[57] ABSTRACT

A well support structure for supporting a casing string from an offshore production platform includes a clamp sized to surround an upper portion of the sidewall of the outer casing or conductor, with the clamp mounted to a carriage to enable the clamp to be moved in at least two transverse directions to position the clamp adjacent the upper end of the string to provide the sole support for the casing string when the carriage and clamp are securing in position relative to the platform.

11 Claims, 7 Drawing Sheets

FIG.6
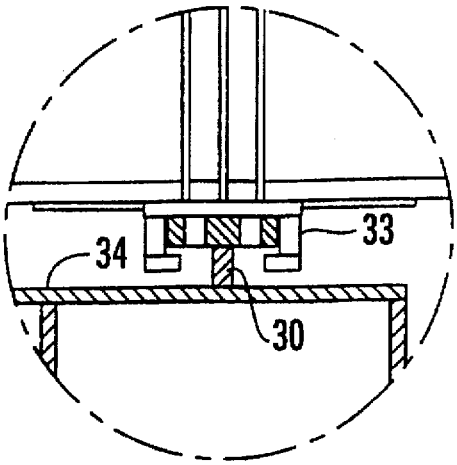
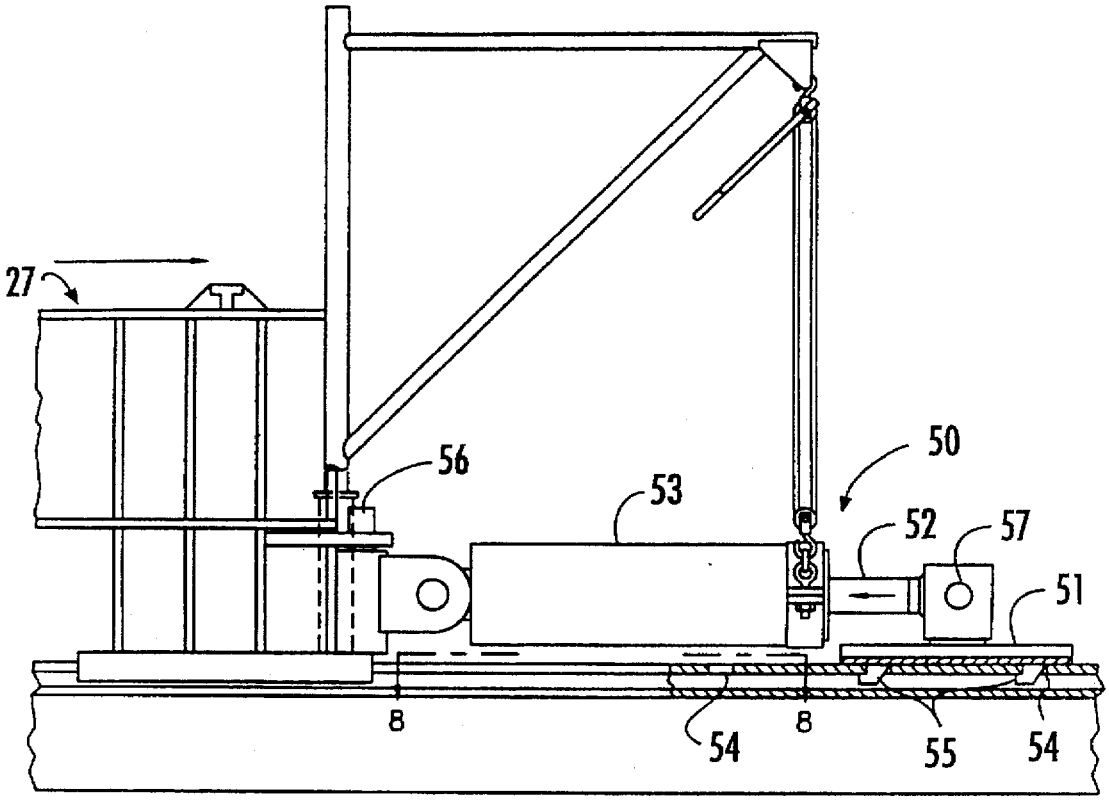
FIG.7
FIG.8
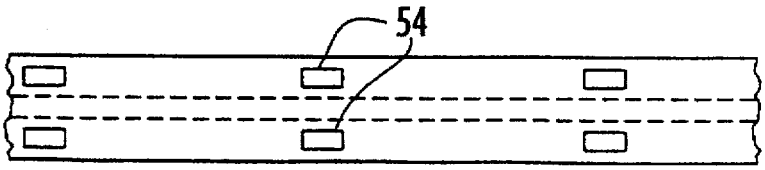

METHOD AND APPARATUS FOR SUPPORTING CASING STRING FROM MOBILE OFFSHORE PLATFORM

FIELD OF THE INVENTION

This invention relates to offshore production from wells, and in particular to structures for supporting an upstanding pipe string casing from a mobile offshore platform.

BACKGROUND OF THE INVENTION

Offshore mobile drilling units are often used for offshore oil and gas drilling in water depths up to about 350 feet. Such drilling platforms can and have been converted to mobile offshore production platforms. With a typical surface well head, an outer layer of casing, which may be protected by a further outer layer or well conductor, is sunk to the required depth and terminates above the water surface. To avoid damage to the casing, it is essential to support it in some manner against the effects of wind and wave motion.

Such support has in the past been provided by various arrangements and constructions of supporting structures having one or more pylons embedded in the sea floor. As can be appreciated, the labor, material and time costs in creating such supports is not insubstantial, particularly when a mobile rig platform could be used.

Mobile drilling rigs generally are constructed in one of two basic platform deck configurations—slotted and cantilever. A slotted deck in a mobile drilling rig is one which includes an aft cut-out with the drill floor and rotary table mounted from the slot edges above the slot. A cantilever deck construction puts the drill floor and rotary table adjacent and above the aft end of the deck, supported from the deck by way of cantilever supports. Some mobile rigs, whether cantilever or slot, include tracks for moving the drill floor and rotary table into the precise position needed for drilling, to allow for the imprecision in precisely positioning the entire rig deck.

Current government regulations applicable to offshore production require that a casing string extending from the sea bed be supported in such a way that the string is capable of withstanding sea conditions that would be encountered in a hundred year storm without being dislodged from the sea bed. Consequently various types of supporting structures have been used to accomplish this result. Examples of such structures are shown in U.S. Pat. Nos. 4,932,811 to Folding, 5,012,875 to Casbarian, 4,907,675 to Cox, 4,842,446 to Carruba, and 4,958,960 to Turner et al. All of these involve one or more piles driven into the ocean floor from which lateral structures extend and provide support to the well conductor. Due to costs and mobility considerations, it would be desirable to have a well conductor support that does not require piles driven into the sea floor and yet is capable of providing sufficient support to the conductor so that it can withstand a hundred year storm. It would be particularly desirable for such a support to be capable of being integrated into a mobile platform such that the platform can be moved into position for production and the platform can then also serve as the sole casing string support structure.

SUMMARY OF THE INVENTION

The present invention provides a well casing or conductor support structure suitable for attachment to a mobile production platform. The support includes means for moving a securing means into position adjacent the casing or conductor, such as a carriage movably mounted on tracks, so that once the platform is moved into position and moored, the conductor support can be moved into position about the casing or well casing or conductor. The well support includes a pipe clamp for surrounding the conductor which is mounted to the carriage either adjacent to or within the plane of the tracks which provide longitudinal and transverse moveability to the clamp. In one embodiment, the tracks are mounted within a deck slot, while in an alternative embodiment, the tracks are mounted on a cantilever structure extending from the perimeter of the platform.

BRIEF DESCRIPTION OF THE DRAWINGS

FIG. 6 is a partial cross section taken along line 6—6 of FIG. 3, illustrating the glide and track portion of the moveable support structure of the invention.

FIG. 7 is a side elevation showing a claw assembly suitable for locating and securing the moveable support structure of the invention.

FIG. 8 is a top view showing the slotted receptacles of the claw assembly of FIG. 7.

DETAILED DESCRIPTION OF A PREFERRED EMBODIMENT

Figure 1:
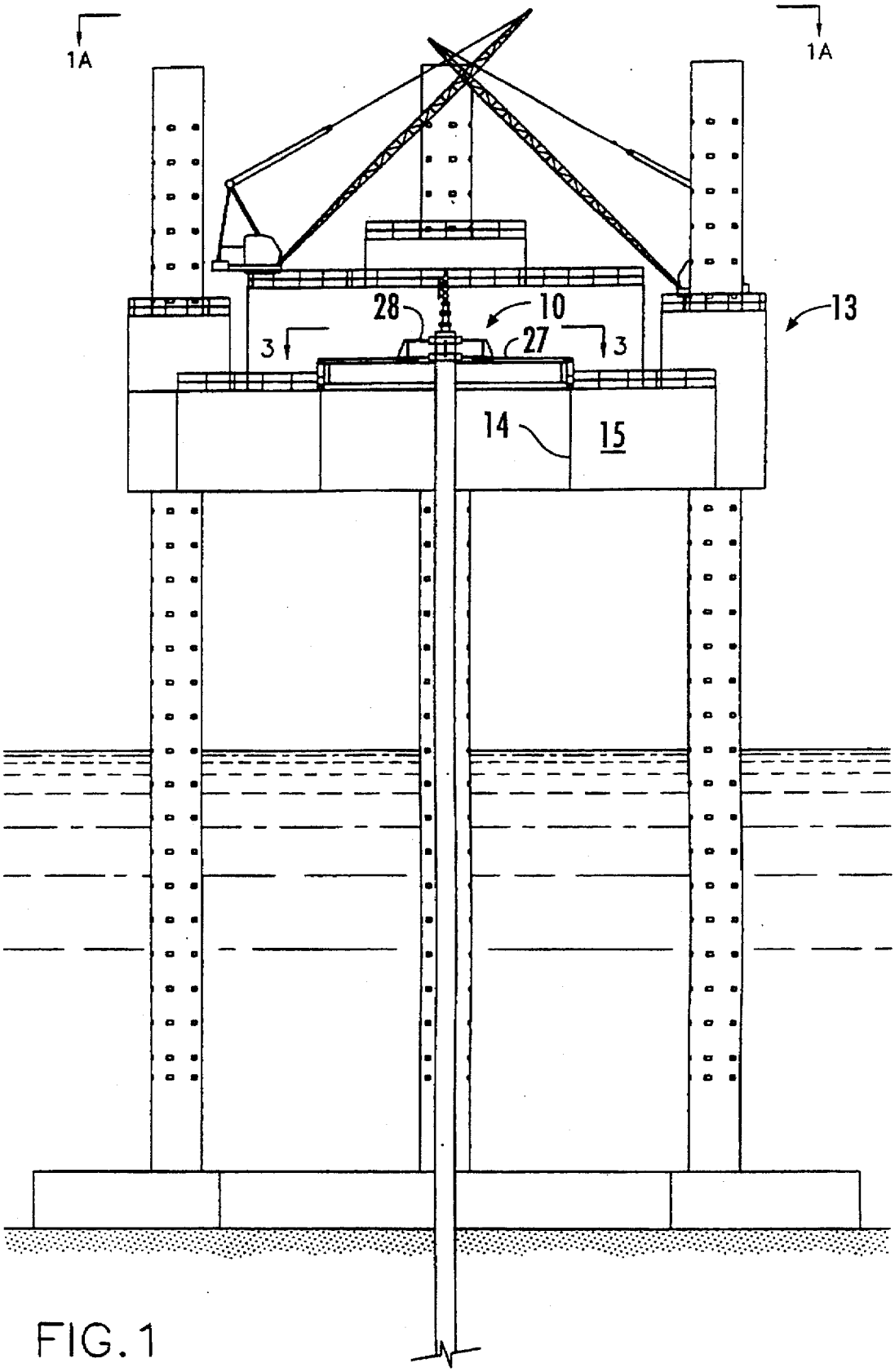
FIG. 1 is a front elevation showing the aft end of a typical slotted production platform showing the moveable casing string support of the present invention in use supporting a fixed conductor.
Figure 1A:
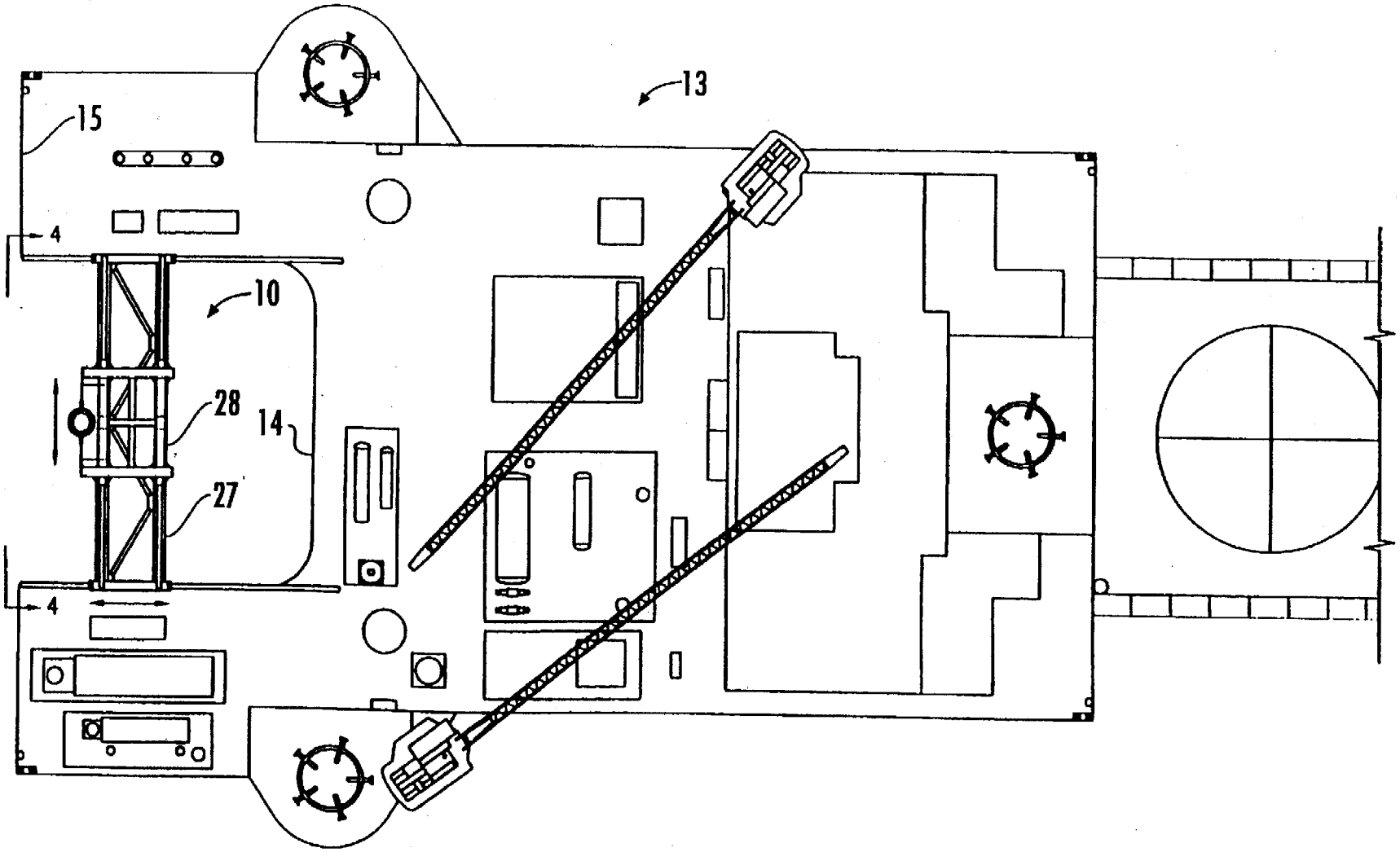
FIG. 1A is a plan view of the platform and support of FIG. 1.
Figure 2:
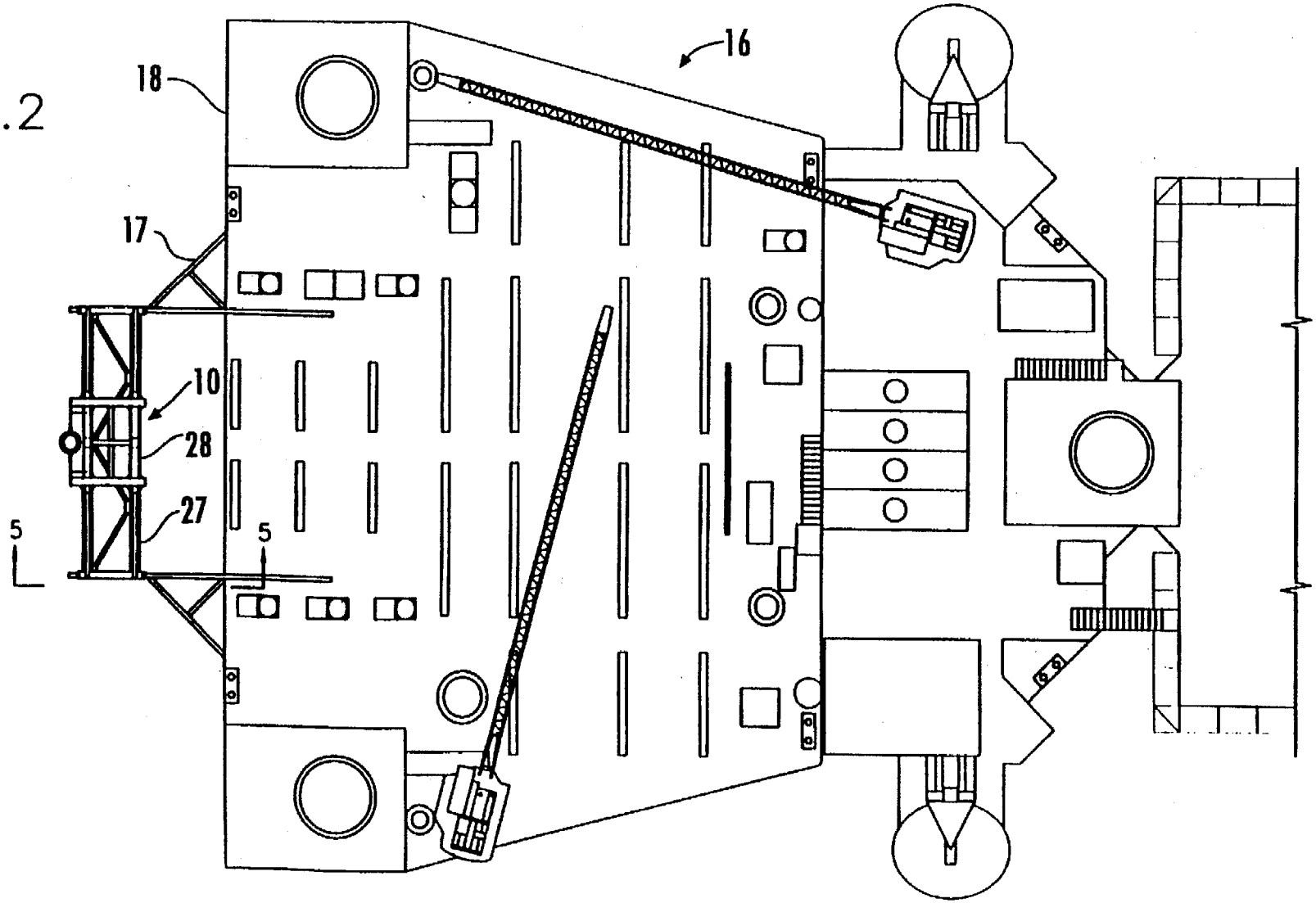
FIG. 2 is a plan view of the outline of a typical cantilevered production platform showing the moveable casing string support of the present invention mounted from aft cantilever portion of a typical cantilever platform.
Figure 5:
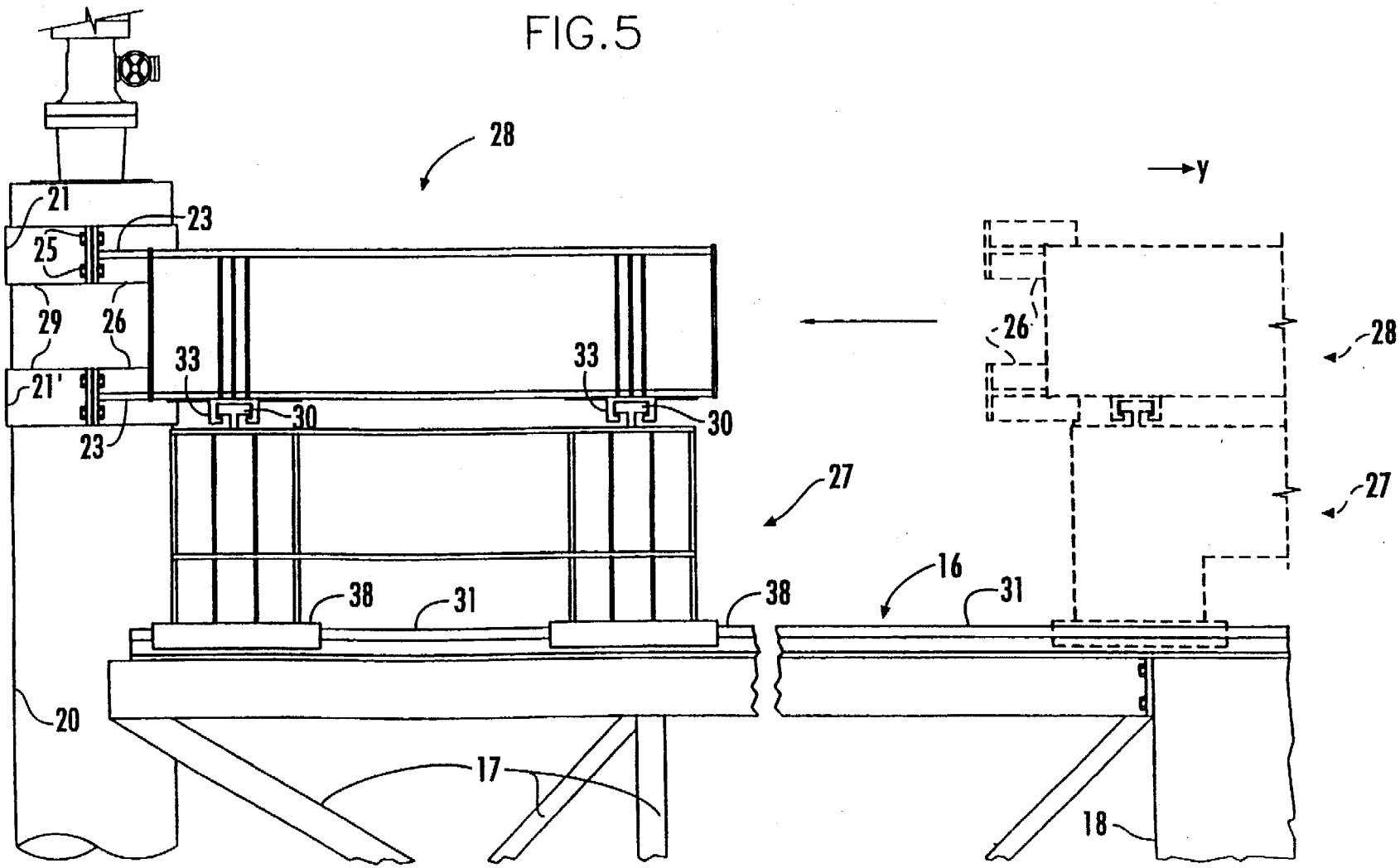
FIG. 5 is a side view of the structure taken along line 5—5 of FIG. 2 showing in phantom the position of the moveable support structure of the invention as it is being move into place to support a casing string.

The Drawing illustrates a preferred embodiment of a moveable casing string support structure 10 in accordance with the invention and several alternative means for moving the structure. Although the moveable casing string support structure 10 can be used with any type of production platform, the invention is illustrated within the context of two typical styles of drilling platforms that have been converted to production platforms. As shown in FIGS. 1 and 1A, slot platform 13 includes a slot 14 formed in aft end 15 of the platform. As will be fully appreciated in light of the following discussion, the existing slot platform 13 can be used to mount the moveable casing string support structure 10 of the present invention. As shown in FIGS. 2 and 5, cantilever platform 16 includes a cantilever supporting structure 17 which can be used to mount the moveable casing string support structure 10 of the present invention. As more fully discussed below, the structure 10 is constructed to move either within the slot 14 in the slot platform 13 (FIGS. 1 and 1A) or above the cantilever supporting structure 17 for the cantilever platform 16 (FIGS. 2 and 5).

Although the invention is illustrated and described below in the context of supporting a casing string surrounded by a protective well conductor 20, it is equally applicable for use to support an unprotected casing string, so long as the string itself is sufficiently rigid to not require additional support to maintain its upright position in calm seas. As used hereinafter, including in particular in the claims appearing at the end of this description, the term "conductor" encompasses either such a rigid casing string or a casing string surrounded by a protective conductor.

The present invention includes a means for retaining or clamping the upper end of the conductor adjacent the platform, including one clamp portion secured to a moveable carriage and a mating clamp portion designed to be secured to the fixed portion to form a clamp for surrounding and securing an upper end of the conductor to the platform by way of the carriage.

Figure 3:
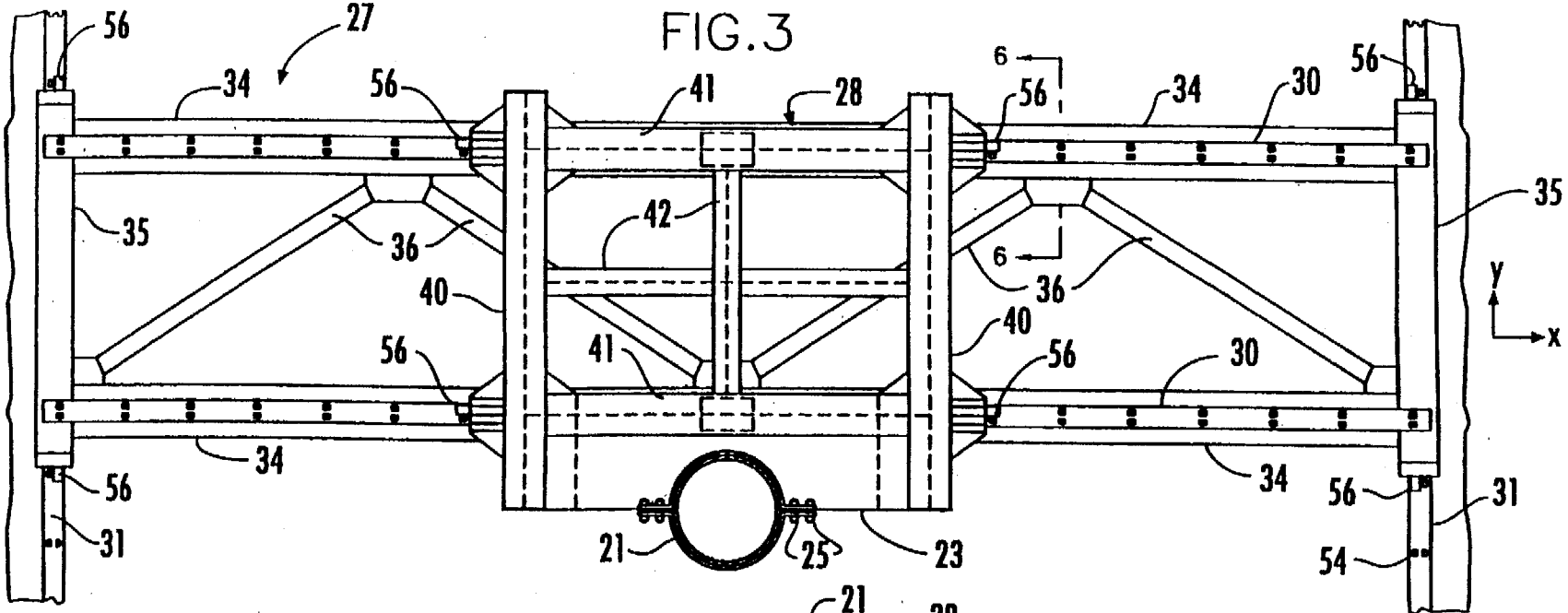
FIG. 3 is an elevated plan view of the moveable support structure of the present invention.
Figure 4:
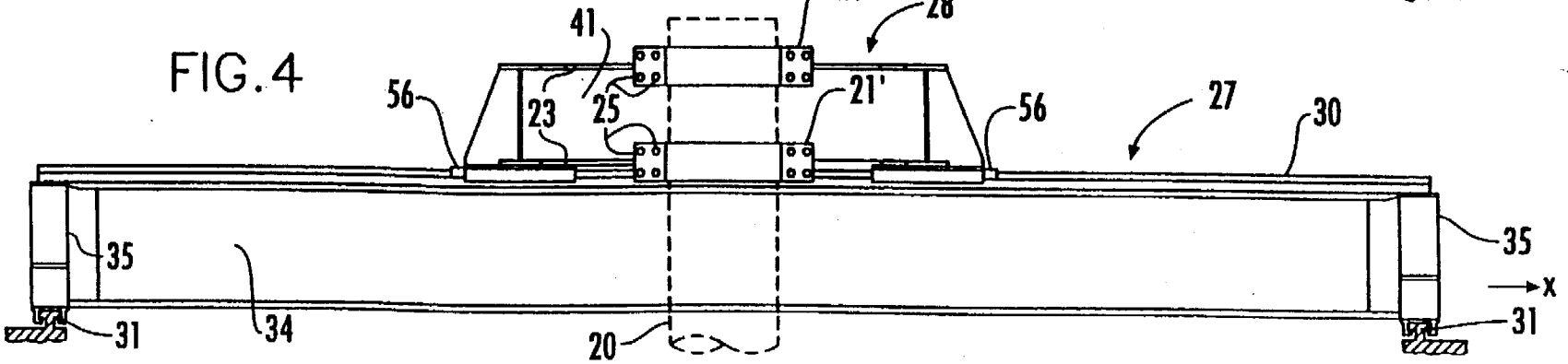
FIG. 4 is a side elevated view of the moveable support structure of FIG. 3 shown mounted on a cantilever platform as in FIG. 2 and in position supporting a casing string.

In the illustrated embodiment in FIGS. 3 through 5, the clamping means is shown as including two vertically aligned clamps 21 and 21' each including a fixed portion 26 mounted by means of a flange 23 from an upper carriage 28, and a mating portion 29 which, when secured together, confine movement of the conductor 20 within the boundary formed by the inner surfaces of the mated clamp bodies 26 and 29. The mating portion 29 attaches to the fixed portion 26 by means of fasteners, such as bolts 25.

As illustrated, the fixed portion 26 of the clamp is carried to its position adjacent the conductor to be supported by the upper carriage 28. The mating porition 29 can be positioned for attachment to the fixed portion 26 by any means available on the platform. Typically, a platform will have some moveable crane or lifting mechanism for moving heavy equipment about the platform which would provide a means for positioning and securing the mating portion 29 to the fixed portion 26.

Although two vertically aligned clamps are illustrated, as can be appreciated, the size and number of clamps is a matter of design choice, depending on manufacturing considerations as well as the outside diameter of the casing string or conductor. As designed for a caisson having a 48 inch outside diameter, in a water depth of 170 feet, two clamps 26 and 29 having a width of 16 inches, thickness of 1.5 inches and inside diameter of 48 inches were found by structural analysis techniques to provide adequate support for withstanding a 100 year storm when secured to the platform by way of the carriage structure described below. Although in the illustrated embodiment, the clamp bodies 21 and 21' are shown mounted to the side of the upper carriage 28, the clamp bodies 21 and 21' may be mounted within the carriages 27 and 28 if the mobile platform is a jack-up platform, as will be more fully appreciated in light of the discussion below.

With continued reference to FIGS. 3 through 5, the invention includes a carriage structure for moving the fixed portion of the conductor clamp or clamps into alignment with the casing string or conductor to be supported. The carriage structure includes a lower carriage 27 which carries the upper carriage 28 to which the fixed clamps 26 and 29 are secured. Each of the upper and lower carriages 28 and 27 are mounted for two way linear movement within the slot 14 or above the cantilever supporting structure 17, e.g. in the X and Y directions illustrated in the Figures. With this arrangement, movement of the carriages along their respective linear paths enables the clamped fixed portions 26 to be positioned at any location within the envelope defined by the slot 14 boundaries or the boundaries of the cantilever supporting structure 17 to support a conductor located anywhere within the envelope.

As illustrated in FIGS. 3–6, a glide and track arrangement provides a suitable means for two way linear movement for the carriages. The upper carriage 28 moves in the X-directions by way of its attached upper glide 33 sliding on upper track 30 which is in turn secured to the upper portion of the lower carriage 27. Similarly, the lower carriage 27 moves in the Y-directions by way of its lower glide 38 sliding on lower track 31 which is mounted to either the platform slot 14 or the platform cantilever supporting structure 17.

As best shown in FIG. 3, the lower carriage 27 consists of cross beams 34 secured to the ends of lateral beams 35. As can be appreciated, the lower carriage 27 requires one or more cross members 36 depending upon the length of the cross beams 34 and the location of the clamps 21 and 21'. For example, if the claims 21 and 21' are positioned outside the structure of the carriages 27 and 28, the lower carriage 27 will require greater structural rigidity, and thus more cross members 36, to withstand the stress and torque caused by the movement of the conductor 20. In contrast, if the clamps 21 and 21' are within the structure of the carriage 27, fewer cross members 36 will be necessary because there will be less stress and torque applied to the carriage 27 by the movement of the conductor 20. Moreover, as the cross beams 34 lengthen to fit a slot, additional cross members 36 will be necessary to provide structural rigidity. For example, as shown in FIG. 1A, on a typical slotted platform 10 of 170 feet by 210 feet, the width and depth of the slot 14 is typically 50 feet. Structural analysis indicates that the cross member arrangement shown in the drawing provides adequate support for the 48 inch caisson situation noted above.

As shown, the upper carriage 28 includes end beams 40 and side beams 41. Lateral braces 42 typically extend between the two end beams 40 and between the two side beams 41. The lateral braces 42 provide structural rigidity to the carriage 28. As can be appreciated, the lateral braces 42 may be constructed in such a manner so as to permit the clamps 21 and 21' to be positioned within the carriage 28 structure. As shown, at least two lateral braces 42 are necessary to provide structural rigidity on a typical carriage 28 of dimensions 20 feet by 20 feet. As designed for supporting a 48 inch caisson in water depth between 30 and 150 feet, structural analysis showed that a lower carriage with tracks to span a 50 feet wide slot made of fabricated welded plate girders 54 inches deep, in combination with a carriage structure constructed from welded plate girders 42 inches deep and having cross bracing made from welded plate girders 42 inches deep with the above described clamps being mounted to the carriage by way of a 2 inch thick steel plate on flange (23) should provide ample structural support to permit the caisson to withstand a 100 year storm without additional support from either the platform or the sea floor.

Any suitable means for moving a carriage along tracks, such as a hydraulic, electric, or gasoline motor, can be used to move the structure into position adjacent the casing string. For example, as shown in FIG. 7, a typical claw assembly 50 of the type that has been used for moving drilling platforms can be adapted for use with the invention. The claw assembly 50 includes claws 55 attached to claw plate 51, piston cylinder 53, piston 55, and a carriage connector 56. As shown, the claw plate 51 is secured to the piston 52 by a fastener, such as a bolt 57, and the claw assembly 50 is secured to the carriage by a carriage connector 56. Prior to moving the carriage, the claw assembly 50 is activated by moving the piston 52 and the attached claw plate 51 to a position such that the claws 55 are engaged within plate slots 54 (FIGS. 7 and 8). Once the claws 55 are secured within the plate slots 54 such that the claw plate 51 cannot move, actuating the claw assembly 50 causes the slidable carriage to move toward the claw plate 51 because the attached cylinder 53 pulls the piston 52 into it.

The claw assembly 50 may be used to move both upper and lower carriages 28 and 27. The upper carriage 28 is moved by the claw assembly 50 such that the clamp body fixed portion 26 is adjacent to the casing string 20. The lower carriage 28 is then moved by the claw assembly 50 such that the clamp body fixed portion 26 engages the casing string 20. Once the casing string is secured by the clamp bodies 21 and 21', the carriages may be repositioned with the clamp assembly 50 to ensure proper alignment of the casing string 20.

Figure 9:
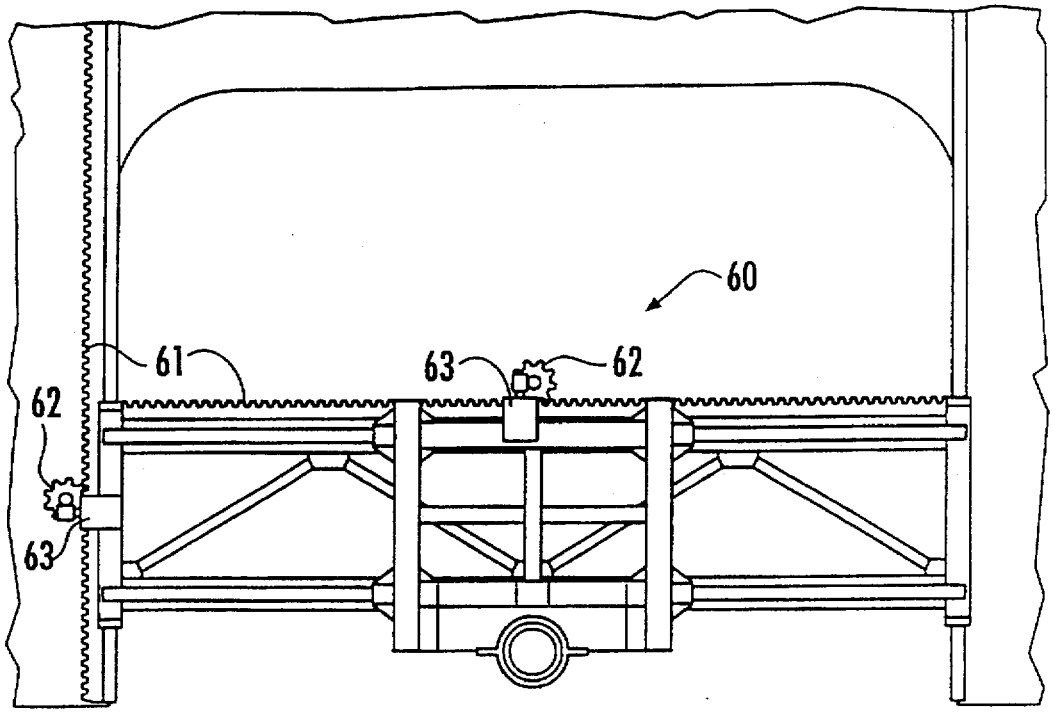
FIG. 9 is an alternative rack and pinion arrangement for locating and securing the moveable support structure of the invention.

Alternatively, as illustrated in FIG. 9, for easier positioning and control of the carriages, a rack and pinion assembly 60 may be used. The rack and pinion assembly 60 includes a rack 61, a pinion 62, and a motor 63 attached to a carriage. As shown, the pinion 62 is attached to the motor 63 and engages the rack 61, which is mounted on the lower carriage 27 and on the slot 10 or the cantilever support structure 17. In operation, the rack engaged pinion 62 is turned by activating the motor 63 and because the motor 63 is secured to the carriage, the slidable carriage moves along its track. The rack and pinion assembly 60 may be used to move both the upper and lower carriages 28 and 27. Again, when using the rack and pinion assembly 60 the upper carriage 28 is moved such that the clamp body fixed portion 26 is adjacent to the casing string 20. The lower carriage 27 may then be moved by its rack and pinion assembly 60 such that the clamp body fixed portion 26 engages the casing string 20. Once the casing string is secured by the clamp bodies 21 and 21', the carriages may be repositioned with its rack and pinion assembly 60 to ensure proper alignment of the casing string 20.

Figure 10:
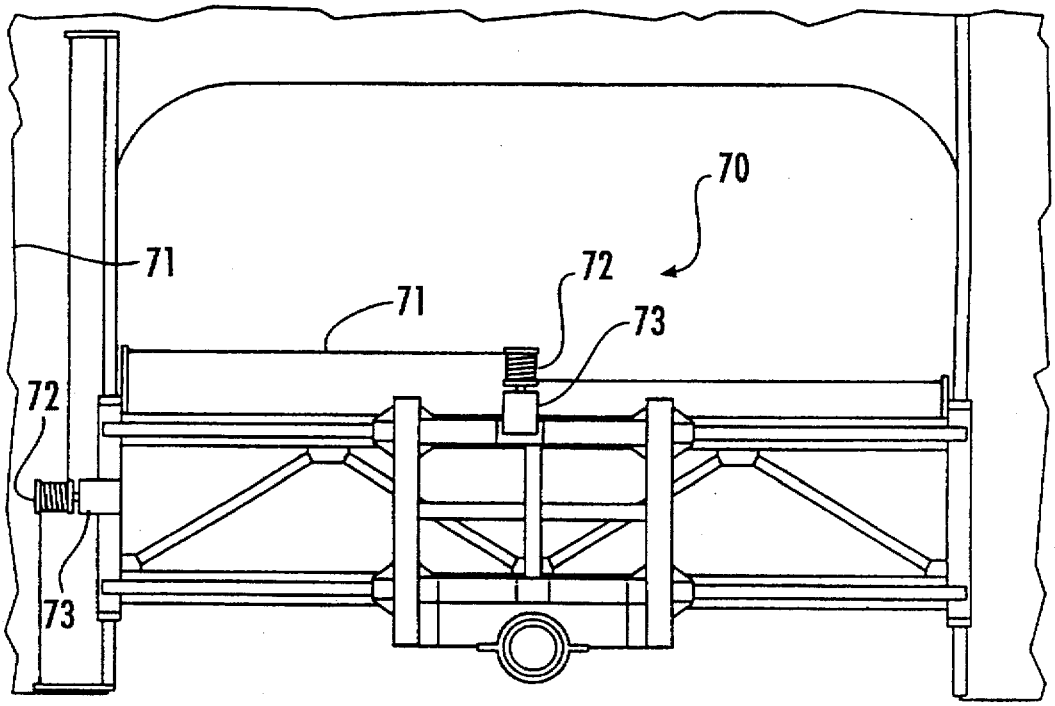
FIG. 10 is an alternative pulley and cable arrangement for locating and securing the moveable support structure of the invention.

A second alternative, shown in FIG. 10, is a cable and pulley arrangement 70, which includes a cable 71, a spool 72, and a motor 73. The ends of the cable 71 are attached to the ends of the carriage tracks. The cable 71 is wrapped around the spool 72, which is secured to a carriage by the motor 73. In operation, the motor 73 turns the spool 72 which in turn causes the carriage to move. As with the other means described for moving a carriage, the cable and pulley arrangement 70 may be used to move both the upper and lower carriages 28 and 27. Also, when using the cable and pulley arrangement 70 the upper carriage 28 is moved such that the clamp body fixed portion 26 is adjacent to the casing string 20. The lower carriage 27 may then be moved by its cable and pulley arrangement 70 such that the clamp body fixed portion 26 engages the casing string 20. Once the casing string is secured by the clamp bodies 21 and 21', the carriages may be repositioned with its cable and pulley arrangement 70 to ensure proper alignment of the casing string 20. As can be appreciated, the choice of alternative power means depends upon the desired design and cost expenditure.

As shown in FIGS. 3 and 4, once the structure 10 is located at the desired position, a carriage securing means, such as chocks 56, are put in abutment to the carriages, to secure the structure 10 in position.

As can now be appreciated, the casing string support of the present invention provides a convenient and cost effective alternative to sea bed supports which is particularly useful with mobile platforms. Although the above detailed description was made in the context of a single casing string, the invention can be used to support any number of conductors at any location within the area defined by the platform's slot or cantilever supporting structure simply by providing additional clamps supported by the carriages. Various modifications of the design and construction of the support can be made without departing from the spirit of the invention, the scope of which is defined by the following claims.

What is claimed is:

1. A well support structure for supporting a well conductor from an offshore production platform against wind and wave motion of the sea and of the platform comprising:

a clamp sized to surround an upper portion of the sidewall of the conductor wherein the clamp includes first and second mating elements to limit movement of said conductor portion;

a carriage mounting the first mating element of the clamp for movement in at least two transverse directions relative to the conductor.

2. The structure of claim 1 further comprising means for securing the carriage in a fixed position relative to the platform.

3. The structure of claim 1 further comprising means for moving the upper and lower carriages.

4. The structure of claim 3 wherein the moving means includes a claw assembly.

5. The structure of claim 3 wherein the moving means includes a rack and pinion assembly.

6. The structure of claim 3 wherein the moving means includes a cable and pulley assembly.

7. The structure of claim 2 wherein the carriage securing means includes chocks positioned on the tracks adjacent to each end of the upper and lower carriages.

8. The structure of claim 2 wherein the carriage securing means includes pins received in each of the upper and lower tracks adjacent to each end of the upper and lower carriages.

9. The structure of claim 1 wherein the first and second clamp mating elements when secured together about the conductor have an inner diameter slightly larger than the outer diameter of said conductor portion.

10. The structure of claim 2 wherein the carriage includes an upper carriage mounting the first clamp mating element for movement in opposing directions relative to the conductor and a lower carriage mounting said upper carriage for movement in opposing directions transverse to the movement of said upper carriage.

11. The structure of claim 10 wherein the upper and lower carriages include a channel glide for riding on a T-shaped track.

* * * * *